US005234350A

United States Patent [19]

Marechal et al.

[11] Patent Number: 5,234,350

[45] Date of Patent: Aug. 10, 1993

[54] SELECTIVE DEVICE FOR ELECTRICAL CONNECTION FITTED WITH SAFETY DISK AND COMPLEMENTARY DISK

[75] Inventors: Gilles Marechal, Paris; Didier Bienvenu, Banthelu, both of France

[73] Assignee: Societe d'Exploitation des Procedes Marechal (SEPM) S.A., Paris, France

[21] Appl. No.: 931,345

[22] Filed: Aug. 18, 1992

[30] Foreign Application Priority Data

Aug. 21, 1991 [FR] France ..... 91 10479

[51] Int. Cl.[5] ..... H01R 13/447; H01R 13/453

[52] U.S. Cl. ..... 439/139; 439/333

[58] Field of Search ..... 439/136, 137, 139, 333, 439/335

[56] References Cited

U.S. PATENT DOCUMENTS

| | | | |
|---|---|---|---|
| 3,500,291 | 3/1970 | Hubbell et al. | 439/333 |
| 3,853,376 | 12/1974 | Marechal | 439/139 |
| 3,982,804 | 9/1976 | Marechal . | |
| 4,176,898 | 12/1979 | Marechal | 439/139 |
| 4,203,640 | 5/1980 | Bice et al. | 439/139 |
| 5,096,432 | 3/1992 | Cullen et al. | 439/139 |

FOREIGN PATENT DOCUMENTS

| | | | |
|---|---|---|---|
| 0093628 | 11/1983 | European Pat. Off. . | |
| 0097749 | 1/1984 | European Pat. Off. . | |
| 2608622 | 9/1977 | Fed. Rep. of Germany . | |
| 1448070 | 6/1966 | France . | |
| 2212655 | 7/1974 | France . | |
| 2270696 | 12/1975 | France . | |
| 2461377 | 3/1981 | France | 439/139 |

*Primary Examiner*—Paula A. Bradley

*Attorney, Agent, or Firm*—Sandler Greenblum & Bernstein

[57] ABSTRACT

Selective device for electrical connection is provided with a plug with multiple contacts designed to engage with the corresponding contacts of a socket, while a safety disk and a complementary disk mounted pivotally on the socket are provided with openings designed for passage of the contacts of the plug and are arranged so as to be entrained in rotation by the plug when the latter is locked on the socket from an initial position which is locked by a locking system that is disengaged when the plug is introduced into the socket. The locking system only acts on the complementary disk while a locking mechanism is provided between the complementary disk and the safety disk in order that the safety disk can be locked in a plurality of pre-established angular positions relative to the complementary disk so that the safety disk can be given an initial position at will by acting on the locking mechanism.

20 Claims, 6 Drawing Sheets

SELECTIVE DEVICE FOR ELECTRICAL CONNECTION FITTED WITH SAFETY DISK AND COMPLEMENTARY DISK

BACKGROUND OF THE INVENTION

1. Field of the Invention

The invention concerns devices for electrical connection of the type comprising a plug with multiple contacts designed to engage with the corresponding contacts of a socket.

2. Discussion of Background Information

It is known, notably through French Patent No. 1,448,070 and its patent of addition No. 90457, the disclosures of which are expressly incorporated by reference in their entireties, by the present assignee, for electrical connection devices to be produced in such a way that with a single model of socket and plug, always connected in the same plane of connection, it is impossible to combine two elements which can not be connected due to the nature of its currents corresponding to each of them. This means that with such a device, if a plug goes into a socket, the socket can supply it with the current that it uses, and conversely, if a plug will not go into a socket, the latter cannot supply the necessary current As in the patent already mentioned, the invention relates mainly but not exclusively to the case of a socket with four contacts or poles spaced on a circumference and, possibly, a ground contact placed in the center.

Each of the two elements—plug and socket—is constituted by a housing and an insulating contact carrier mounted so as to be adjustable in relative orientation in relation to the housing while the housings of the two elements carry mating means for guiding and locking by rotation arranged so that these elements can only be joined together in a single relative angular position The sockets with different power supplies (for example: 500 volts three-phase, 380 volts three-phase, 110 volts single-phase, 24 volts single-phase, etc.) and the corresponding plugs are differentiated by assigning each nominal current a given relative angular position of the contact carrier in its housing. When the number of these different relative positions is sufficient (of the order of twenty), i.e. at least equal to the number of industrial currents normally in use, it is possible to fix the position corresponding to a given current once and for all and thus establish a system of standardization valid for the industry as a whole.

In addition, a safety disk made of insulating material is mounted so as to pivot on the socket so as to be able to be entrained in rotation by the plug, coaxially with the circumference on which the contacts are located, when the plug is locked on the socket. This safety disk is provided with openings designed for passage of the contacts of the plug and spaced on a circumference lying over that on which the contacts are located and disposed such that at the end of the locking rotational movement only certain contact locations are uncovered, and means are provided so that this safety disk is locked in an initial position in which all the contacts are masked when the plug and the socket are disconnected.

In the known devices, the safety disk is locked in the selected initial position by engaging at least one protrusion carried out by a safety collar surrounding the contact carrier with one of a plurality of spaced slots on the periphery of the disk, the collar being drawn towards the disk by an elastic means and immobilized in rotation by guiding means. The collar is pushed back by the plug when the latter is introduced into the socket, allowing the safety disk to be unlocked. According to FR 2,212,655 in the name of the present assignee, and whose disclosure is expressly incorporated by reference thereto in its entirety, the slot corresponding to the correct initial position for the desired nominal current may advantageously only be unlocked at the time of initial assembly.

Such an embodiment has certain drawbacks which are due to the fact that the safety disk has a dual function to mask all the contact locations in the initial position and to uncover given contact locations in the final connection position.

This is why French Patent 2,270,696 in the name of the present assignee, and whose disclosure is expressly incorporated by reference thereto in its entirety, proposes to dissociate the two functions by means of a second so-called complementary disk made of insulating material which is mounted so as to pivot on the socket coaxially with the safety disk and arranged so as to be entrained in rotation at the same time as the latter between the initial position and the final connection position, the complementary disk being provided with openings equal in number to that of the contact locations on the socket and spaced in the same way as the latter, while the relative angular position of the socket and the complementary disk is such that the openings line up with the contact locations in the final position.

Thus, the complementary disk is designed to mask all the contact locations in the initial position while the safety disk retains its functions of selecting the contact locations to be uncovered in the final position.

In this known system the complementary disk has two diametrically opposite slots and the safety disk has a plurality of cavities spaced around its circumference.

The initial position of the two disks is assured by two protrusions projecting from a safety collar already mentioned previously in connection with the embodiment with a single disk, the protrusions being designed to engage both through the slots in the complementary disk and in two of the cavities in the safety disk.

It is understood that the initial position of the complementary disk is always the same, whereas that of the safety disk is selected at the same time of assembly according to the desired nominal current.

However, it is also clear that this position of the disks in relation to the socket is fixed and thus only corresponds to a single current, and is also only known to the initial assembler.

This is all the more of a nuisance as the installer generally tests the connections, for which he exerts pressure on the collar using any appropriate means, such as a plug in order to unlock the disks and turn them to uncover the contacts. Thus, in the course of the resetting operation, there is a risk of selecting another cavity for the safety disk and thus changing the relative position of the two disks.

SUMMARY OF THE INVENTION

This is why according to the present invention there is provided a means of changing the initial position of the safety disk by a special operation while, at the same time indicating, without risk of error, the nature of the current for which the connection device is set up.

Thus, it is an object of the present invention to provide a device of the type mentioned previously, fitted among other things with a safety disk, a complementary disk and a locking system for the initial position of the disk which is disengaged when the plug is introduced into the socket, this device being remarkable, in particular, in that the locking means are provided between the complementary disk and the safety disk so that the latter can be locked in a plurality of predetermined angular positions relative to the complementary disk so that the safety disk can be given an initial position at will by acting on the locking means.

Advantageously, at least one part of the locking means is visible on the upper face of the safety disk so that this visible part makes it possible to identify the nature of the current for which the device is set up according to its position on the disk since the current depends on the initial position of the safety disk.

This dual function of the locking means is highly advantageous because it not only becomes possible to change the current for which the device is set up at will but the current for which it is set up is also immediately identifiable.

Preferably, the locking means comprise a pin mounted in a fixed angular position in the complementary disk and drawn toward the safety disk by elastic means so as to co-operate with holes formed in the latter so as to be able to lock the two-disks together in a plurality of identifiable relative angular positions, while the pin can be disengaged at will by moving it against elastic means in order to change the relative initial position of the safety disk in relation to the complementary disk and thus in relation to the socket.

According to a first embodiment, the contact carrier of the socket comprises a recess designed to receive one part of the pin when the latter is disengaged from the hole in the safety disk in which it is located when it is desired to change the relative position of the disks.

According to another embodiment, the pin is entirely disposed in the complementary disk into which it can be retracted. Advantageously, in this case the pin is disposed at the end of a lever forming a spring.

By way of example, the safety disk takes the form of a cover provided with a peripheral rim turned towards the socket and covering the complementary disk while the holes for the pin take the form of openings.

Conversely, according to another embodiment, it is the complementary disk that is provided with a peripheral rim turned away from the socket and in which the safety disk is housed while the openings for the pin take the form of slots formed on the periphery of the safety disk.

Notably, to permit the installer to test the connections as mentioned previously, and according to one embodiment, the complementary disk and the contact carrier of the socket are provided with mating means to allow a limited range of relative pivoting movement of the one in relation to the other between the initial and final connection positions, respectively, of the plug in the socket, this range of pivoting movement thus corresponding to the angle of rotation allowed for the rotational locking and unlocking movement of the housings of the plug and the socket.

Thus, after the disks have been unlocked, it is possible to entrain them to uncover the contacts before returning to the initial position, the rotations in one direction and the other being limited by the mating means.

By way of example, these limiting means comprise a projection provided on the complementary disk or on the contact carrier of the socket respectively and designed to co-operate with a recess corresponding to the desired range through the length of the arc of the circle and formed on the contact carrier of the socket or the complementary disk respectively.

In addition, and incidentally but advantageously for a device in which the safety and complementary disks each exhibit a central opening for passage of the pin of the ground contact, the central opening in the safety disk is extended by a tubular element which passes through the central opening in the complementary disk to engage inside the insulating carrier by snap engagement and hold the disks.

BRIEF DESCRIPTION OF THE DRAWINGS

The invention will be clearly understood on reading the non-limiting embodiments and description which follow, and which refer to the attached drawings in which:

FIG. 10 corresponds to FIG. 7, but in an unlocked position after rotation of the disks;

DETAILED DESCRIPTION OF THE PREFERRED EMBODIMENTS

The drawings illustrate two embodiments of the present invention, with the locking means entailing some changes to the disk being based on the principles of the invention. It is also possible to mix certain elements from one embodiment with the other. In fact, the differences between the illustrated embodiments essentially derive from technical manufacturing problems due to different dimensions according to the nature of the power supplies concerned.

For the sake of clarity, identical or quasi-identical elements have been given the same numbers, whereas neighboring elements and elements with the same function are differentiated from one embodiment to the other by a "prime".

Figure 5:
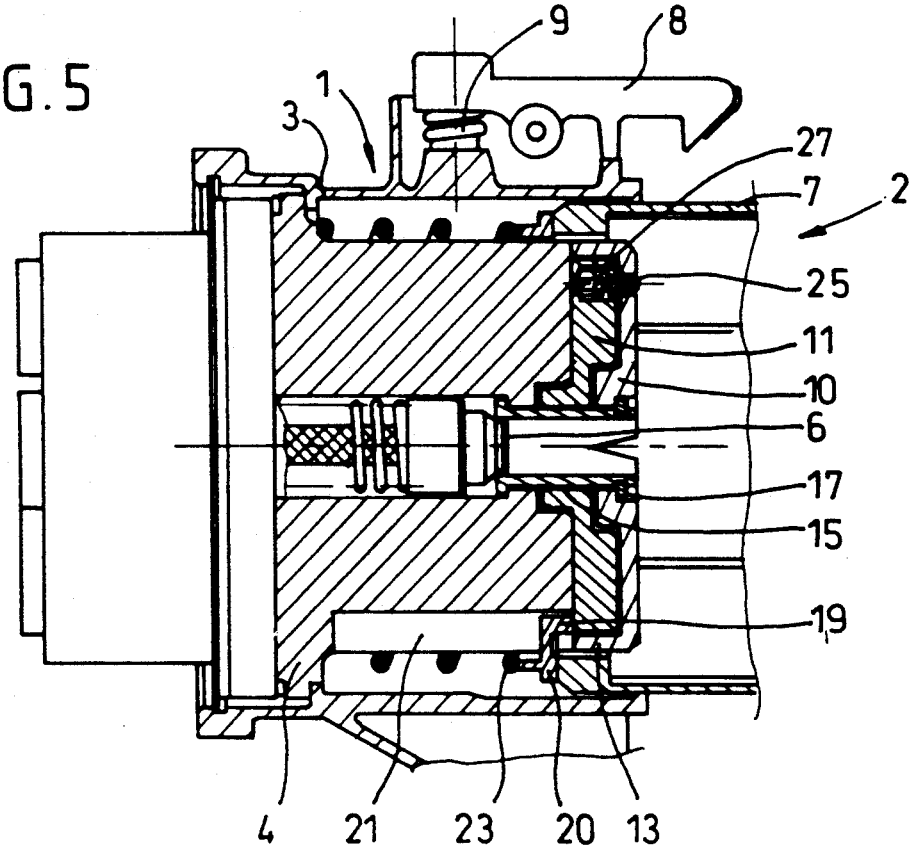
FIG. 5 is a section along line V—V in FIG. 4.
Figure 3:
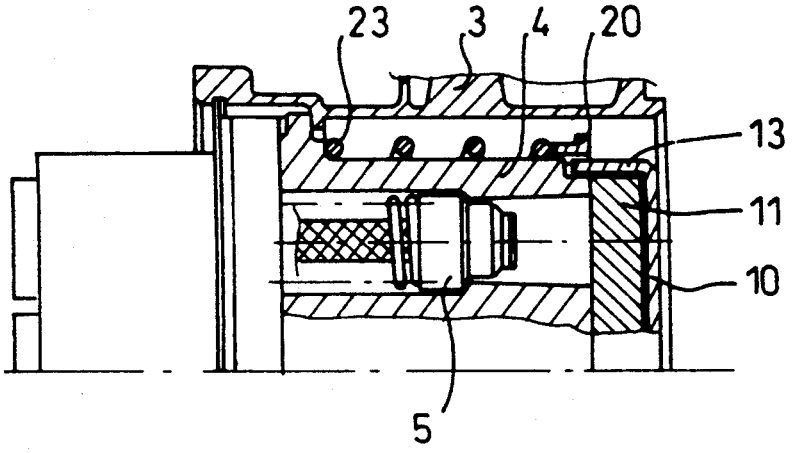
FIG. 3 is a half-section through the line III in FIG. 1.
Figure 6:
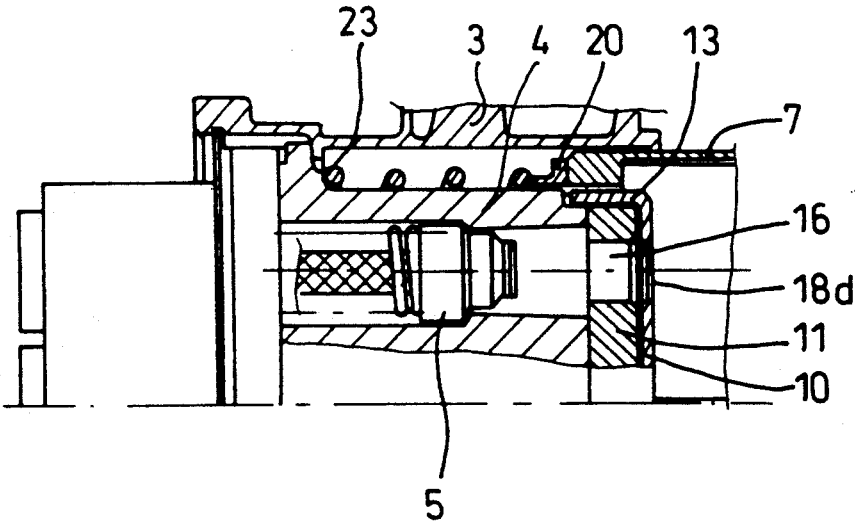
FIG. 6 is a half-section through the line VI in FIG. 4.
Figure 7:
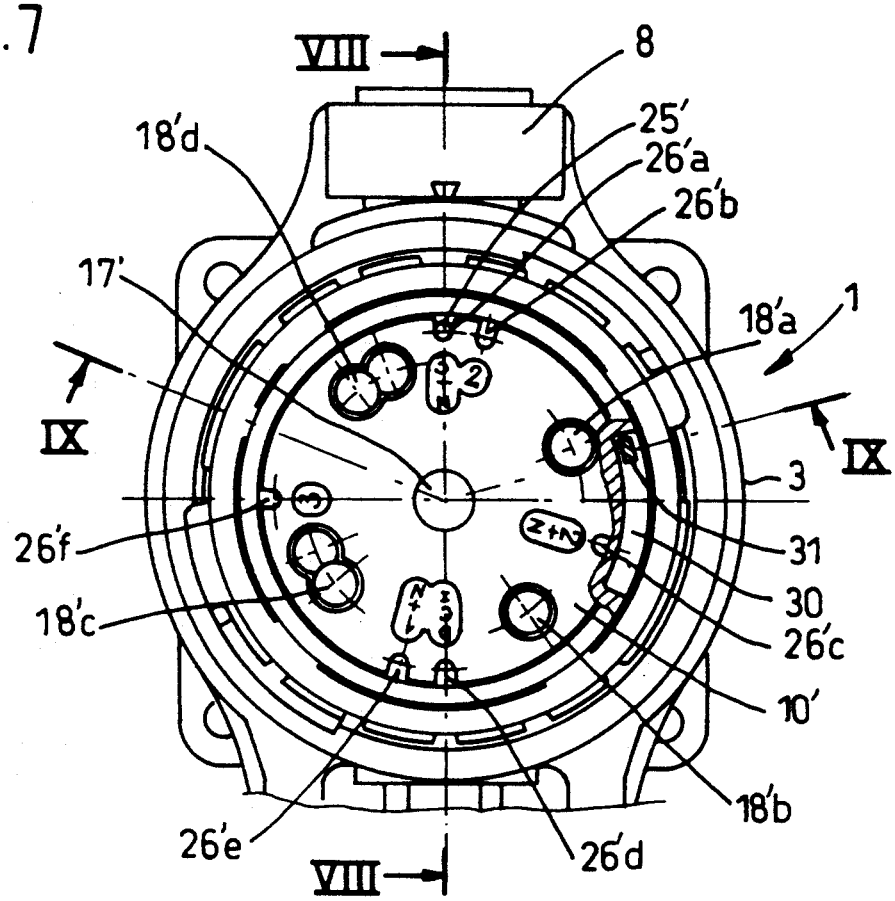
FIG. 7 is a plan view of the socket of a device according to a second embodiment of the invention in a first initial locked position.
Figure 12:
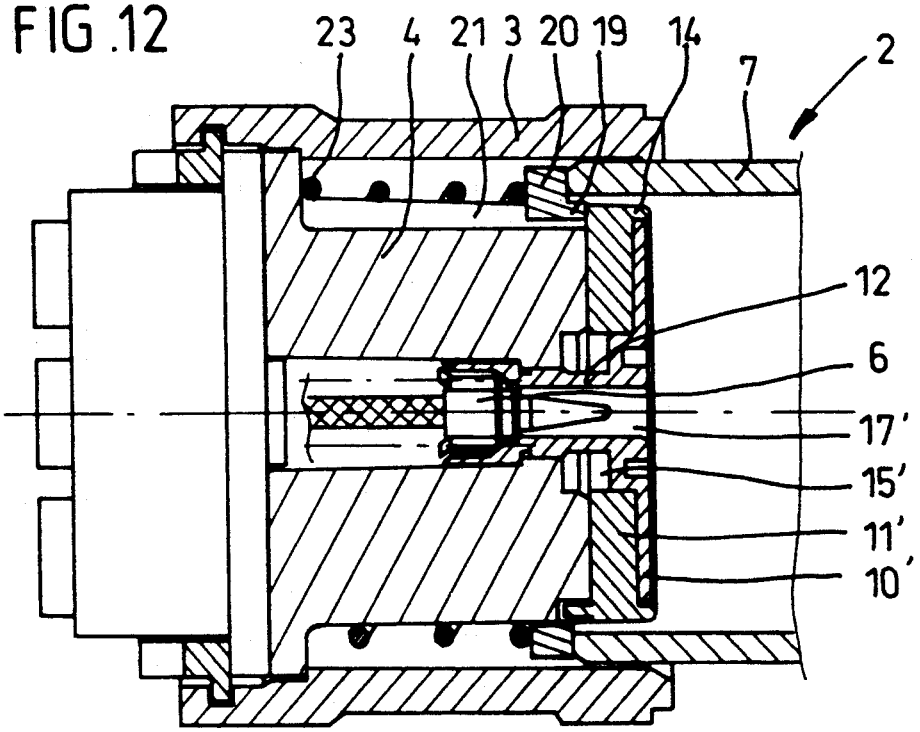
FIG. 12 is a section along line XII—XII in FIG. 10.
Figure 1:
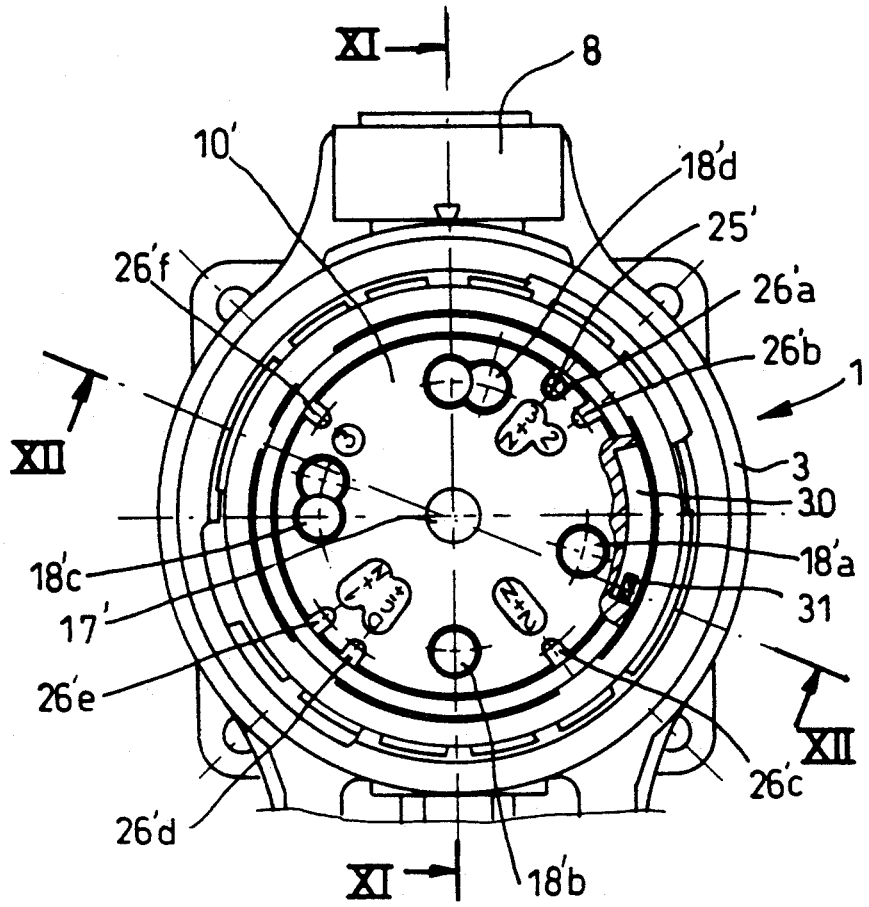
Figure 11:
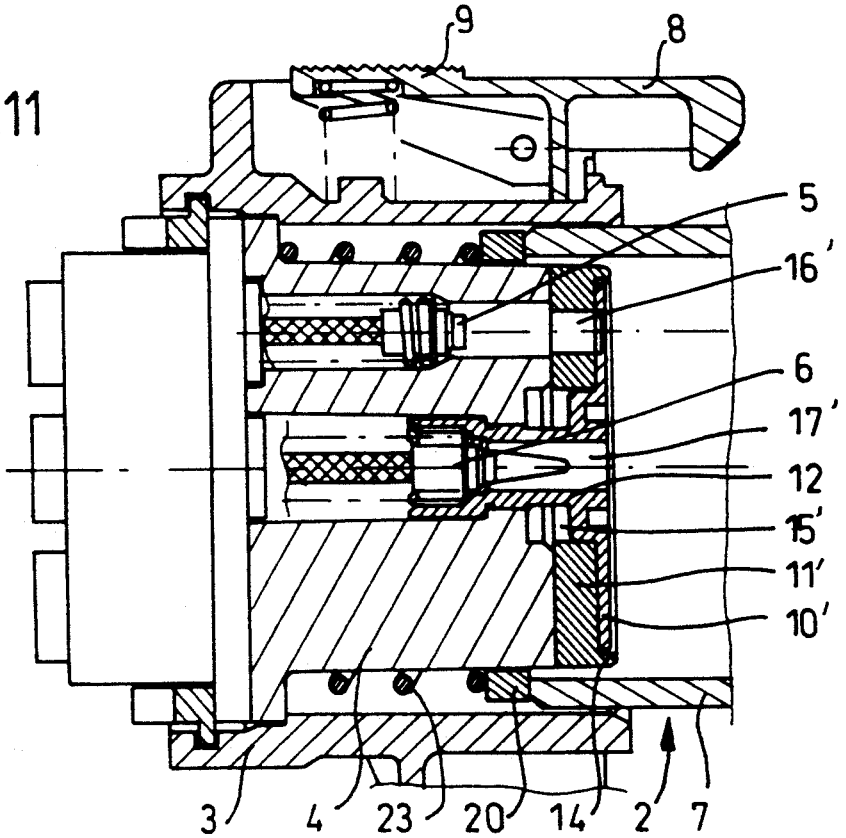
FIG. 11 is a section along line XI—XI in FIG. 10.

The connection device according to the invention is composed of a fixed socket 1 which can be seen in all the figures, and a detachable plug 2 (FIGS. 5, 11 and 12).

The socket 1 itself comprises an external housing 3 enclosing an insulating carrier 4 in which are mounted four contacts such as 5 (FIGS. 3, 6, 8 and 11) referred to hereinafter as the contacts of the socket, and a central ground contact 6 (FIGS. 2, 5, 8, 9, 11 and 12). The plug comprises an external housing 7 (shown in part in FIGS. 5, 6, 11 and 12) enclosing an insulating carrier in which are mounted electrical contacts, and a central ground contact (not shown). When the plug is removed from the socket 1, a cover (not shown) can be folded down over the latter and locked in the closed position by bolt 8 (FIGS. 1, 2, 4, 5, 7, 8, 10 and 11), itself held by a spring 9 (FIGS. 2, 5, 8 and 11).

The four contacts of the sockets are disposed in the standard way and the locations of the contacts of the plug are mated with the contacts of the socket, but the only contacts fitted are those corresponding to the current required for the circuit to be supplied.

The insulating carrier 4 of the socket and the insulating carrier of the plug can generally adopt a plurality of relative positions in relation to their respective housing.

Thus, a given relative position is associated with a given current through its nature and its effective voltage, for example: 380 volts alternating current, 220 volts alternating current, 110 volts direct current, 48 volts alternating current, 24 volts direct current, etc.

The housing 7 of the plug can only be introduced into the housing 3 of the socket axially in one given angular position by virtue of the presence of a pin for example, not shown, locked to one of the two housings and arranged so that the plug is located fully in the socket in three steps, namely: firstly, by introducing the plug into the socket with an axial translation movement; secondly, by relative rotation of the two housings through a certain angle which brings the contacts of the plug into line with the contacts of the socket; and lastly, a third step in which the contacts are effectively engaged by pushing the plug axially into the socket a second time. This arrangement is obtained through a bayonet fitting of any suitable conventional type, for example.

A safety disk 10 (FIGS. 1 to 6), 10' (FIGS. 7 to 12) and a complementary disk 11 (FIGS. 1 to 6), 11' (FIGS. 7–12) are mounted pivotally on the insulating carrier 4 of the socket.

The safety disk 10 essentially take the form of a cover provided with a rim 13 (FIGS. 2, 3, 5 and 6) turned towards the socket and covering the complementary disk 11, while conversely the complementary disk 11' is provided with a peripheral rim 14 (FIGS. 8, 9, 11 and 12) turned away from the socket and housing the safety disk 10'.

The complementary disk 11, 11' is provided with a central opening 15, 15' (FIGS. 2, 5, 8, 9, 11 and 12) and four openings such as 16 and 16' (FIGS. 6 and 11 respectively) spaced exactly like the contacts of the socket on a circumference of the same radius as the circumference on which the latter are spaced. In a manner known per se, the safety disk 10, 10' comprises a central opening 17, 17' and a plurality of openings (18*a*–18*d*; 18'*a*–18'*d*) located on a circumference equal to the circumference on which the contacts are spaced. Two of the latter (18*c*, 18*d* and 18'*c*, 18'*d*) are oblong holes for the reasons indicated in the patent of addition mentioned previously.

In the embodiment in FIGS. 1 to 6, the disks 10 and 11 are held against the carrier 4 by the head of the central ground contact 6, which at the same time serves as a pivot for the disks.

According to the variant of the embodiment in FIGS. 7 to 12, the central opening 17' in the safety disk 10' is extended by a tubular element 12 (FIGS. 8, 9, 11 and 12) designed to engage by snap engagement inside the insulating carrier 4 to hold the assembly of the disks 10' and 11' after passing through the central opening 15' in the complementary disk 11'.

In addition, as the drawings show, the safety disk 10, 10' may exhibit an annular protuberance around its central opening 17, 17' which is housed in a corresponding recess in the complementary disk 11, 11'. Moreover, according to the embodiment in FIGS. 1 to 6, an annular protuberance is also provided in the complementary disk 11, which is housed in a corresponding recess in the carrier 4.

The disks 10, 11 and 10', 11' respectively are entrained in rotation by the plug when the plug is locked in the socket.

It is understood that the complementary disk 11, 11' is designed to mask all the contacts of the socket when it is in its initial position.

The initial positioning of the complementary disk 11, 11' is assured by a locking protrusion 19 (FIGS. 2, 9 and 12) projecting from a safety or ejecting collar 20 (FIGS. 2, 3, 5, 6, 8, 9, 11 and 12).

The ejecting collar 20 is immobilized in rotation only in relation to the carrier 4 of the socket, for example, through the engagement of at least one tab pointing axially inwards in a longitudinal slot 21 (FIGS. 2, 5, 9 and 12) formed in the lateral surface of the carrier 4. It is the right-angled end of the tab which constitutes the locking protrusion 19 for example.

The collar 20 is drawn towards the disk 10, 10' for example by a spring 23 surrounding the body of the carrier 4.

The locking protrusion 19 is designed to engage in a slot 24, 24' (FIGS. 2 and 9) formed in the complementary disk 11, 11'.

In order to lock the disks 10, 11 and 10', 11', respectively, in various relative positions, a pin 25 (FIGS. 1, 2, 4 and 5), 25' (FIGS. 7, 8 and 10) is mounted in a fixed angular position in the complementary disk 11, 11', and it is drawn towards the safety disk by elastic means discussed further on, to co-operate with holes 26*a*–26*f* and 26'*a*–26'*f* respectively formed in the latter.

Given the slightly different structures of the disks 10, 11 on the one hand and 10', 11' on the other hand, the holes 26*a* to 26*f* in disk 10 are openings while the holes 26'*a*–26'*f* in the disk 10' take the form of slots (disk 10' pivoting in the disk 11').

In addition, the pin 25 in the first embodiment takes the form of a piston drawn by a spring 27 while the complementary disk 11 is drilled under the pin and the carrier 4 comprises a recess 28 (FIG. 2) designed to receive a part of the pin when the latter is disengaged from the opening in the safety disk in which it is located.

Figure 8:
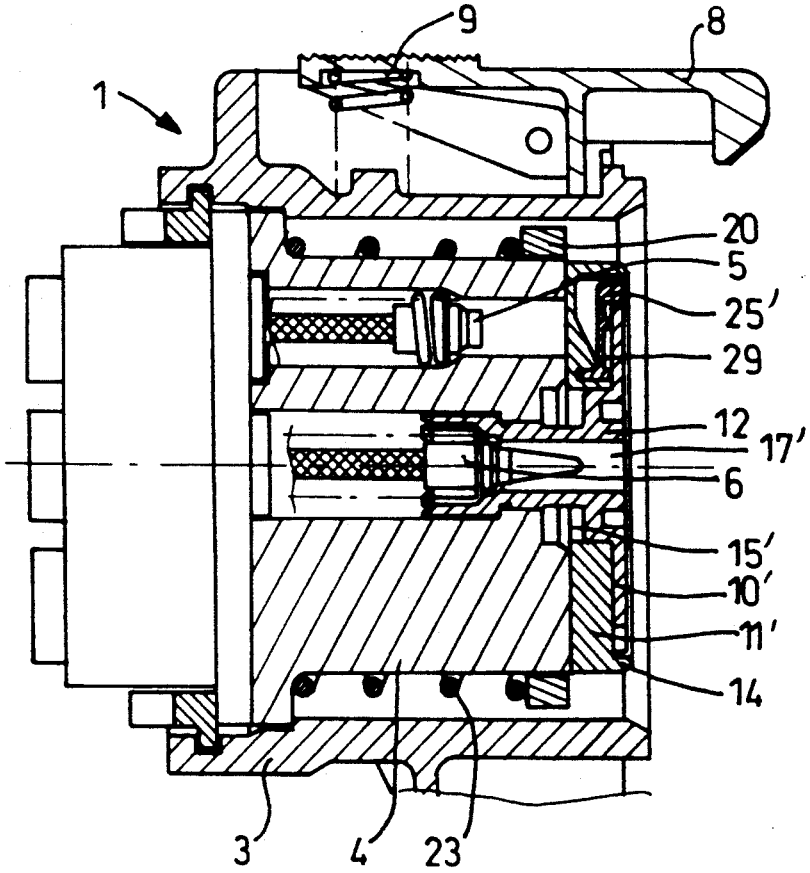
FIG. 8 is a section along line VIII—VIII in FIG. 7.
Figure 9:
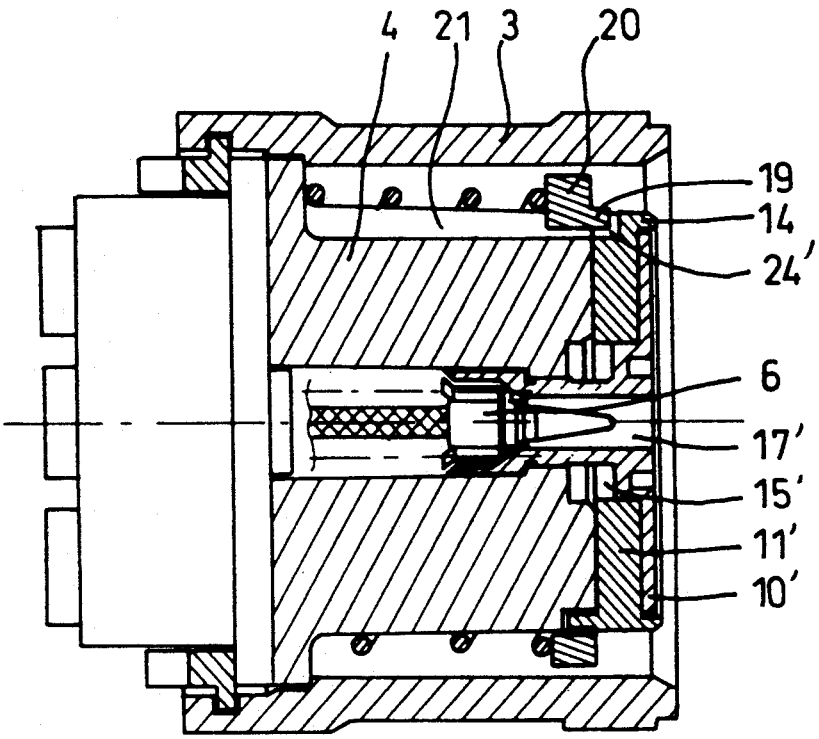
FIG. 9 is a section along line IX—IX in FIG. 7.

In a slightly different way, the pin 25' in the other embodiment is entirely disposed in the complementary disk 11' into which it can be retracted as shown more particularly in FIG. 8. In this embodiment the pin 25' is disposed at the end of a lever 29 (FIG. 8) forming a spring.

However, it is clear that if the first embodiment shown is more particularly designed for higher power levels, certain characteristics of one embodiment may easily be used in the other.

For example, the pin 25 in the first embodiment may replace the pin 25' in the second embodiment with or without he retraction recess 28 and vice-versa, etc.

Thus, it is understood that the disk 11, 11' and thus the pin 25, 25' assume a fixed initial position in relation to the socket determined at the time of assembly, whereas the safety disk may assume various initial angular positions since it is sufficient firstly to move the pin 25, 25' from the hole 26*a* to 26*f* or 26'*a* to 26'*f* which is occupied (by pressing by means of a tool or other implement), its other end entering the recess 28 in the carrier 4 in the case of the first embodiment or retracting completely into the disk 11' in the second embodiment, and then to turn the disk 10, 10' to enable the pin 25, 25' to engage in another hole.

The holes 26*a* to 26*f* and 26'*a* to 26'*f* respectively thus correspond to the various currents desired and their angular positions are naturally selected accordingly.

Moreover, as the pin 25, 25' is visible on the upper face of the disk 10, 10' (and a bright color could also be adopted), the nature of the current corresponding to the hole being used is indicated in the vicinity of the latter (see the markings 1, 2, 3, 1+N, 2+N, 3+N, DC in FIGS. 1, 4, 7 and 10, for example).

Starting from a given position (FIGS. 1, 2, 3, on the one hand and 7, 8,, 9 on the other hand) in which the safety disk 10, 10' is locked in the position 3+N for example by the pin 25, 25' while the disk 11, 11' is locked by the protrusion 19 of the collar 20, first the plug is pressed into the socket so that the front end of the housing 7 of the plug (FIGS. 5, 6, 11, 12) pushes back the collar 20 against the spring 23. This disengages the protrusion 19 from the slot 24, 24' (FIGS. 2, 5, and 9, 12, respectively). The plug is then moved in rotation such that the disks 10, 11 and 10', 11' respectively entrained by co-operation of the contacts of the plug and the openings in the disks uncover the desired contacts of the socket.

This translation and rotation and unlocking corresponds to passing from FIGS. 1, 2, 3 to FIGS. 4, 5, 6 and from FIGS. 7, 8, 9 to FIGS. 10, 11 and 12 respectively.

Moreover, as shown more particularly in FIGS. 1, 4, 7 and 10, to limit the range of relative pivoting movement of the disks 10, 11, 10', 11' and of the carrier 4, a projection 30 is provided under the disk 11, 11' (or on the carrier 4 respectively) which is designed to co-operate with a recess 31 corresponding to the desired range through the length of the arc of the circle and is formed on the carrier 4 (or under the disk 11, 11' respectively). The range of pivoting movement thus allowed between the initial and final connection positions respectively thus corresponds to the angle of rotation allowed for the locking and unlocking rotational movement of the housing of the plug and the socket.

This application is related to French Application No. 91 10479, filed Aug. 21, 1991, the priority of which is claimed. The disclosure and drawing of this French application are hereby expressly incorporated by reference thereto in their entirety.

Although the invention has been described with reference to particular means, materials and embodiments, it is to be understood that the invention is not limited to the particulars disclosed and extends to all equivalents within the scope of the claims.

What is claimed:

1. A selective device for electrical connection, comprising:

a socket having circumferentially-positioned multiple contacts;

a plug having multiple contacts capable of engaging corresponding multiple contacts of said socket;

each of said plug and said socket comprising a housing and an insulating contact carrier, the housings of said plug and said socket including mating means for guiding and locking by rotation, and arranged so that they can only be joined together in a single relative angular position;

a safety disk and a complementary disk, each composed of insulating material, mounted to pivot on said socket coaxially with the circumference on which the multiple contacts are located, said safety disk and said complementary disk including openings for passage of the contacts of said plug, and being arranged so as to be entrained in rotation by said plug when said plug is locked on the socket from a given initial position of said safety disk and the complementary disk in which only certain contact locations are uncovered at the end of the rotational movement, this initial position of said safety disk and said complementary disk being locked by a locking system, which is disengaged when said plug is introduced into said socket, and said locking system only acts on the complementary disk; and means for locking are provided between said complementary disk and said safety disk for locking said safety disk in a plurality of pre-established angular positions relative to the complementary disk so that said safety disk can be given an initial position by acting on said means for locking.

2. The device according to claim 1, wherein at least one part of said means for locking is visible on an upper face of the safety disk so that this visible part makes it possible to identify the nature of the current for which the device is set up by virtue of its position on the disk since said current depends on the initial position of the safety disk.

3. The device according to claim 2, wherein said means for locking comprise a pin mounted in a fixed angular position in said complementary disk and drawn towards said safety disk by an elastic element to cooperate with apertures formed in said safety disk so as to be able to lock the two disks together in a plurality of identifiable relative angular positions, said pin can being disengageable by moving it against said elastic element in order to change the relative initial position of said safety disk in relation to said complementary disk, and thus in relation to said socket.

4. The device according to claim 3, wherein said insulating contact carrier of said socket comprises a recess to receive a part of said pin when said pin is moved out of said aperture in said safety disk in which it is located when it is desired to change relative positioning of said safety disk and said complementary disk.

5. The device according to claim 3, wherein said pin is entirely disposed in said complementary disk into which said can be retracted.

6. The device according to claim 5, wherein said pin is positioned at an end of a lever forming a spring.

7. The device according to claim 6, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

8. The device according to claim 1, wherein said means for locking comprise a pin mounted in a fixed angular position in said complementary disk and drawn towards said safety disk by an elastic element to cooperate with apertures formed in said safety disk so as to be able to lock the two disks together in a plurality of identifiable relative angular positions, said pin can be disengaged by moving it against said elastic element in order to change the relative initial position of said safety disk in relation to said complementary disk, and thus in relation to said socket.

9. The device according to claim 8, wherein said insulating contact carrier of said socket comprises a recess to receive a part of said pin when said pin is moved out of said aperture in said safety disk in which it is located when it is desired to change relative positioning of said safety disk and said complementary disk.

10. The device according to claim 9, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

11. The device according to claim 8, wherein said safety disk comprises a cover having a peripheral rim turned towards said socket and covering said complementary disk, and said apertures for said pin comprise openings.

12. The device according to claim 11, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

13. The device according to claim 8, wherein said complementary disk comprises a peripheral rim turned away from said socket and in which said safety disk is housed, and said apertures for said pin comprise slots formed on a peripheral portion said safety disk.

14. The device according to claim 13, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

15. The device according to claim 8, wherein said pin is entirely disposed in said complementary disk into which said pin can be retracted.

16. The device according to claim 15, wherein said pin is positioned at an end of a lever forming a spring.

17. The device according to claim 16, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

18. The device according to claim 1, wherein said complementary disk and said insulating contact carrier of said socket comprise means for mating to allow a limited range of relative pivoting movement in relation to each other between initial and final connection positions, respectively, of said plug in said socket, this range of pivoting movement corresponding to the angle of rotation allowed for rotational locking and unlocking movement of the housings of said plug and said socket.

19. The device according to claim 18, wherein said means for mating for limiting the range of pivoting movement comprise a projection on said complementary disk or on said insulating contact carrier of said socket for cooperating with a recess corresponding to a desired range through a length of an arc formed on said insulating contact carrier of said socket or said complementary disk.

20. The device according to claim 1, wherein said safety disk and said complementary disk each comprise a central opening for passage of a pin of a ground contact, said central opening in said safety disk being extended by a tubular element which passes through said central opening in said complementary disk to engage by snap engagement inside the insulating carrier to hold the disks.

* * * * *

UNITED STATES PATENT AND TRADEMARK OFFICE

CERTIFICATE OF CORRECTION

PATENT NO. : 5,234,350

DATED : August 10, 1993

INVENTOR(S) : GILLES MARECHAL et al.

Figure 1:
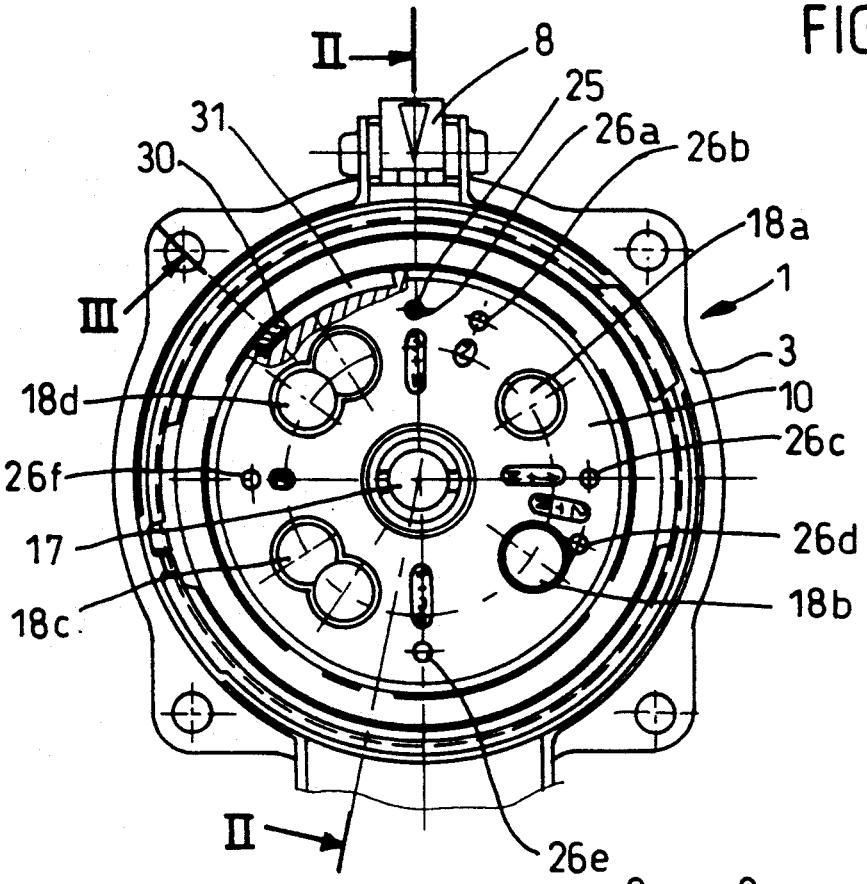
FIG. 1 is a plan view of the socket of a device according to a first embodiment of the invention in a first initial locked position.
Figure 2:
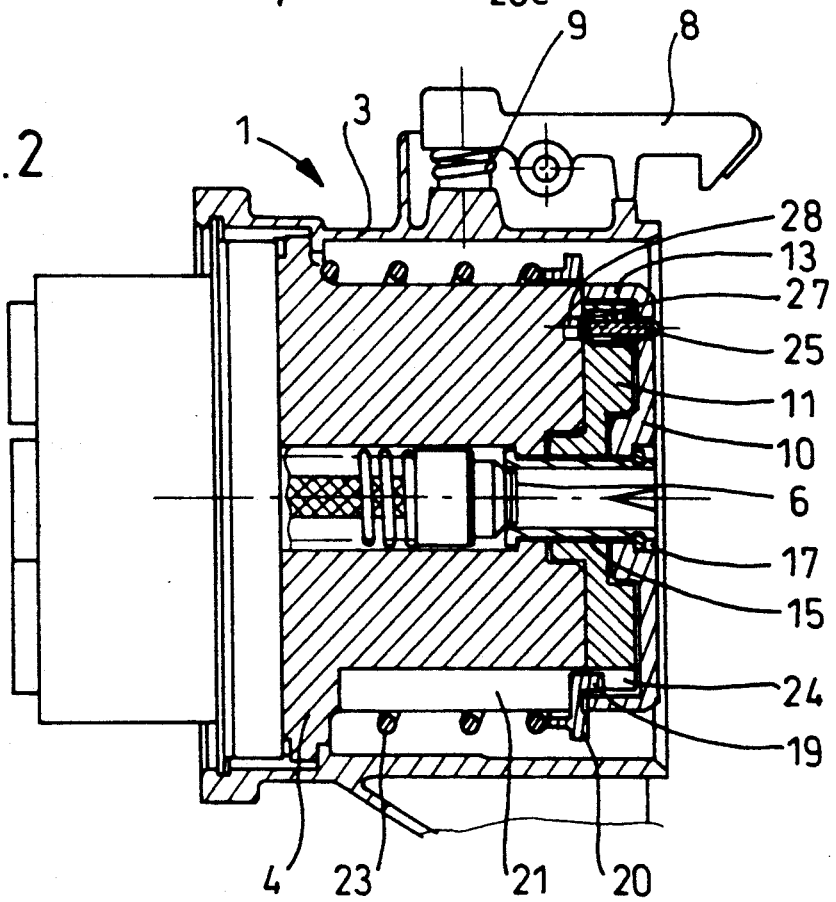
FIG. 2 is a section through line II—II in FIG. 1.
Figure 4:
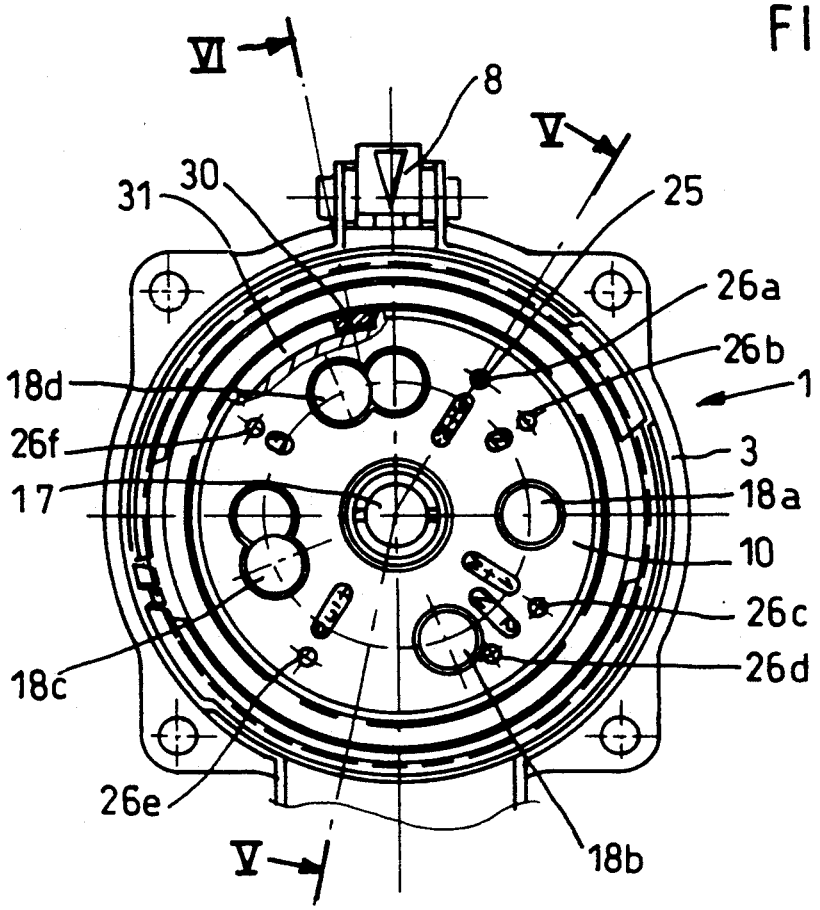
FIG. 4 corresponds to FIG. 1, but in the unlocked position after rotation of the disks.

It is certified that error appears in the above-indentified patent and that said Letters Patent is hereby corrected as shown below:

In the drawings, sheet 6 of 6, change "FIG. 1" to ---FIG. 10---.

At column 8, line 34 (claim 3, line 7), change "pin can being" to ---pin being---.

At column 8, line 47 (claim 5, line 3), change "said can" to ---said pin can---.

Signed and Sealed this

Seventeenth Day of May, 1994

Bruce Lehman

*Attest:*

BRUCE LEHMAN

*Attesting Officer*

*Commissioner of Patents and Trademarks*